United States Patent [19]

Campbell

[11] 4,343,158

[45] Aug. 10, 1982

[54] PORTABLE POUCH FOR INSULIN

[76] Inventor: June H. Campbell, P.O. Box 4162, Foster City, Calif. 94404

[21] Appl. No.: 246,240

[22] Filed: Mar. 23, 1981

[51] Int. Cl.[3] ..... F25D 3/08

[52] U.S. Cl. ..... 62/372; 62/457; 150/2.5

[58] Field of Search ..... 156/3, 2.2, 2.5 X; 62/371, 372, 529, 530, 457

[56] References Cited

U.S. PATENT DOCUMENTS 4,079,767 3/1978 Howard ..... 150/3
4,127,155 11/1978 Hydorn ..... 150/3 X
4,211,091 7/1980 Campbell ..... 62/372
4,250,998 2/1981 Taylor ..... 62/371 X
4,295,345 10/1981 Atkinson ..... 62/457 X

FOREIGN PATENT DOCUMENTS 1254986 1/1961 France ..... 62/530

*Primary Examiner*—Lloyd L. King
*Attorney, Agent, or Firm*—T. R. Zegree

[57] ABSTRACT

A portable, flexible, refrigerating pouch for carrying and storing insulin needed by diabetics to prevent it from deterioration is disclosed. The pouch comprises an insulating layer and a liner whose structure provides separate compartments for a refrigerating agent, a vial of insulin and a syringe.

8 Claims, 4 Drawing Figures

PORTABLE POUCH FOR INSULIN

BACKGROUND OF THE INVENTION

This invention relates generally to preservation of insulin from spoiling. More particularly, the invention relates to protection of liquid insulin from deterioration by carrying and storing it in a portable, insulated, refrigerated pouch.

As is well known, persons afflicted by diabetes mellitus have an insufficient secretion of insulin causing an excess of sugar in their system. Such condition requires treatment consisting of hypodermic injections of insulin which assists the body in using the sugar. In order to maintain an insulin preparation in a fresh condition, it should be kept at a temperature lower than normal room temperature. This requires the storage of insulin in a refrigerator or other cooling means, such as an ice box. However, diabetics requiring a few injections of insulin per day are greatly inconvenienced while away from home for a day or longer with no available facilities needed to keep their supply of insulin under desired cool conditions.

While rigid ice chests and pliable, insulated bags, such as the lunch bag disclosed in my U.S. Pat. No. 4,211,091, for temporary storage of foodstuffs are known, the present invention is directed to an improved, small size container, the purpose and constructional features of which are distinct therefrom and which can accommodate not only a supply of liquid insulin, but also a refrigerating means and one or more syringes for injection of insulin. Consequently, the present invention contemplates the provision of a complete, refrigerated kit containing insulin and its accessories for use by diabetics when away from home.

OBJECTS OF THE INVENTION

Accordingly, it is the principal object of the present invention to provide a carrying means specifically adapted for storage of insulin without its spoilage.

Another object of the invention is to provide a portable pouch containing a refrigerating agent, the pouch being capable of insuring storage of insulin at a sufficiently low temperature inside thereof to prevent effectively its deterioration for several hours.

Another object of the invention is to provide an insulated, small and pliable pouch of sufficient storage capacity to accommodate a refrigerant, a vial of insulin and a syringe, the pouch being so constructed that, when closed, the cool air inside thereof maintains insulin in a fresh condition suitable for injection into the body.

A further object of the invention is to provide a flexible pouch having a special design for carrying and storing a vial of insulin and accessories of various shapes needed for injection thereof which is inexpensive to manufacture from readily available materials.

Still another object of this invention is to provide a novel method for protecting insulin from deterioration by keeping it in a portable, insulated and refrigerated pouch thereby permitting its use at any time while away from home.

These and other objects of the invention will become more fully apparent from the following description considered in conjunction with the accompanying drawings.

BRIEF SUMMARY OF THE INVENTION

In accordance with the present invention, there is provided a portable, flexible, insulated open-mouth pouch especially adapted for use in carrying and storing insulin to prevent deterioration thereof. The pouch comprises a pair of opposing walls joined to one another to form a closed bottom for said pouch. Each of said walls includes an outer wall, an inner wall and a layer of an insulating material distributed substantially evenly therebetween. The pouch further comprises means for opening and closing thereof which is secured to the pouch in the upper portion of its inner wall around the periphery thereof. Still further, the pouch comprises a water-repellent liner disposed inside thereof. The upper narrow portion of the liner is attached to the inner wall of the pouch adjacent the top thereof, the major portion of the liner being unattached and disposed adjacent the inner wall of the pouch. The construction of the liner includes a front partition and a rear partition forming a central pocket therebetween for holding a refrigerating means, the bottom of the pocket being disposed adjacent the bottom of the pouch. The front partition forms together with the front wall of the liner a first compartment for holding a vial of insulin, the rear partition forming together with the rear wall of the liner a second compartment for holding a hypodermic syringe.

BRIEF DESCRIPTION OF THE DRAWINGS

In the accompanying drawings.

Like reference characters indicate corresponding elements throughout the views of the drawings.

DETAILED DESCRIPTION

Figure 1:
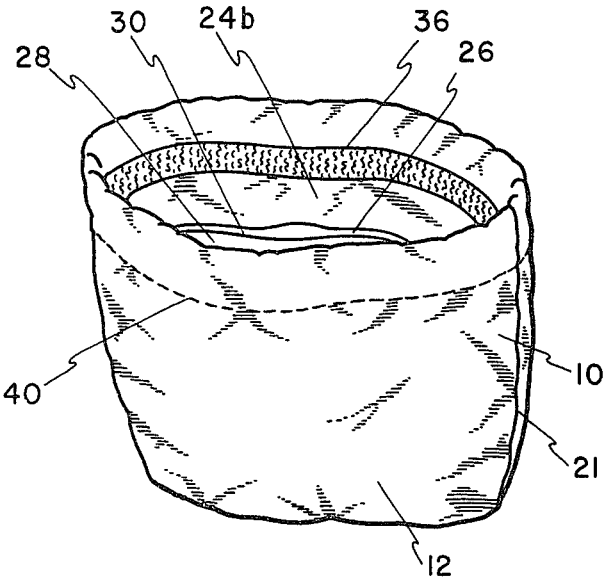
FIG. 1 is a perspective view of the pouch for carrying insulin.

Referring to the drawings in detail, a flexible, insulated pouch 10 of the open-mouth type construction comprises a front outer wall 12, a rear outer wall 14, a front inner wall 18 and a rear inner wall 20, the walls being made of a durable, flexible fabric material, such as cotton, polyester, nylon or a plastic sheet. A layer of a suitable insulating material 16 formed of a lightweight polymeric material, such as polystyrene or polyurethane foam, is disposed substantially evenly between the outer walls and inner walls filling the space therebetween. The walls are joined together by a seam 21, preferably formed by stitching, extending downwardly from the top to the bottom of pouch 10 on one side thereof and by a similar seam on the opposite side thereof thereby producing a pouch structure having open top and a rounded edge bottom 22, as illustrated in FIG. 2.

Figure 2:
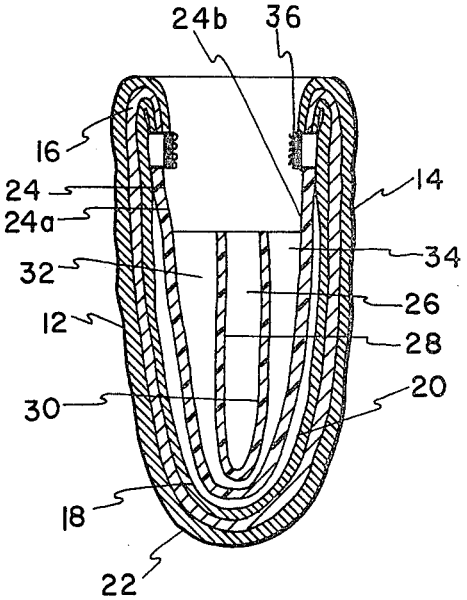
FIG. 2 is a vertical cross-sectional view of the empty pouch in open top position.
Figure 4:
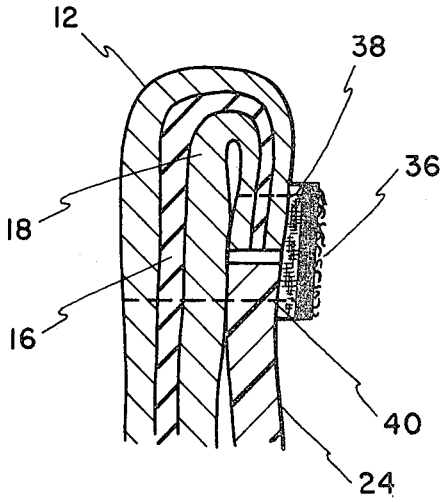
FIG. 4 is a fragmentary enlarged cross-sectional view of the upper portion of the front wall of the pouch showing the construction thereof in detail.

The upper portions of each wall are folded inwardly and downwardly over a relatively short distance from the top edge of pouch 10, as shown in FIGS. 2 and 4, the end portion of each overlapping fold being positioned between inner wall 18 and the means for opening and closing 36 of the pouch 10, preferably a strip of an adhesive tape fastener sold commercially under the trademark "Velcro." The tape fastener 36 is disposed around the inner periphery of pouch 10 a short distance below the top edge thereof in a direction generally parallel thereto. When the opposing surfaces of tape fastener 36 are brought in contact and pressed together, a substantially air-tight seal is produced thereby preventing the cooled air to escape from the interior of pouch 10. Other similar tape fasteners capable of forming a strong but readily detachable bond therebetween are also suitable. Likewise, other known types of means for opening and closing pouches or bags, such as zippers, snaps, buttons, etc. are satisfactory.

The strip of tape fastener 36 is secured to the folded end portions of opposite walls 12, 18 and 14, 20 by an upper stitch 38 which is disposed in the upper portion of the fastener 36 and by a lower stitch 40 which extends through the entire combined thickness of the upper end portion of liner 24, the inner wall 18 adjacent thereto, the layer in insulating material 16 and the outer wall 18, as illustrated in FIG. 4. A corresponding lower stitch (not shown) is arranged in the same manner on the opposite side of pouch 10.

Figure 3:
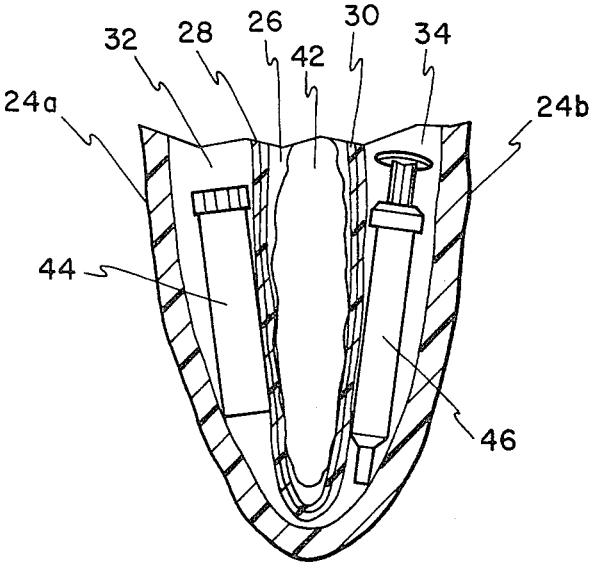
FIG. 3 is a fragmentary enlarged cross-sectional view of the lower portion of the liner showing the two compartments holding a vial of insulin and a hypodermic syringe, respectively, and the central pocket with a refrigerating agent placed therein.

The liner 24 is preferably made of a waterproof or water-repellent sheet material, such as a continuous, relatively thin but resistant to tear, flexible plastic film of the vinyl type or a rubber-treated fabric. Its construction includes front wall 24*a* and rear wall 24*b* and is specifically designed to accommodate a refrigerant, such as a frozen ice pack 42, a rubber-stoppered vial 44 containing liquid insulin and one or more hypodermic syringes, as shown in FIG. 3. A central pocket 26 having closed bottom is formed by a front partition 28 and a substantially identical rear partition 30, each partition being formed of a double layer of the same liner material and so arranged as to form a first compartment 32 between the front wall 24*a* and front partition 28, as well as a second compartment 34 between the rear partition 30 and rear wall 24*b*. As the size of the central pocket 26 must be sufficient to accommodate a removably insertable frozen ice pack 42, the pocket 26 extends vertically over a distance preferably equal to more than a half of the height of pouch 10, as shown in FIG. 2.

Although the weight of the ice pack 42 placed in the central pocket 26 causes the bottom of the pocket 26 to contact the interior of liner 24 adjacent the bottom 22 of pouch 10, thereby forming separate compartments 32 and 34, the outer edge portion of the bottom of pocket 26 may be joined, if desired, by stitching or any other suitable manner, to liner 24 at the bottom portion thereof thereby providing a permanent separation of the two compartments 32 and 34.

The portable pouch 10 according to this invention provides an improved method of protecting insulin from deterioration, particularly in extreme hot or cold weather conditions, by placing a vial of liquid insulin in one of the two compartments 32 or 34 in the pouch 10 having an inserted therein frozen ice pack 42. When pouch 10 is tightly closed by means of tape fastener 36 or the like, the chilled air in the interior of the pouch preserves insulin from spoilage. This is highly desirable and advantageous for diabetics who must give themselves insulin injections while away from home for at least several hours either traveling by car, train or plane or in an office, a school, a factory, etc. By the present invention I have provided a solution to a long sought problem of insulin-dependent diabetics whose primary concern is not to expose insulin to unfavorable weather conditions and who now can carry with them a supply of chilled, fresh insulin with either disposable or reusable syringes together with a suitable sterilization means for the needle, such as prepackaged alcohol sponge, if necessary, regardless of the outdoor temperature level. The invention is especially applicable to the users of short-acting regular insulin who require three to four subcutaneous injections per day. Due to its small size, the pouch of this invention may conveniently be placed in a purse, a totebag, a satchel or even in a coat pocket, as well as in the glove compartment of an automobile. Moreover, the invention may be used in preservation of other medicinal preparations requiring storage at a low temperature.

Various changes in the form of this invention herein described and illustrated may be made without departing from the spirit of the invention and the scope of the claims which follow.

I claim:

1. A portable, flexible, insulated, cooling, open-mouth pouch especially adapted and sized for (use in) carrying and storing a vial of insulin to prevent deterioration thereof comprising:

a pair of opposing walls joined to one another (to form) providing a rounded closed bottom for said pouch, each of said walls including an outer wall, an inner wall and a layer of insulating material distributed substantially evenly therebetween;

means for opening and closing said pouch, said means being secured to said pouch in the upper portion thereof around the inner periphery thereof; and a flexible, water-repellent liner disposed inside said pouch, the upper narrow portion of said liner being attached to said inner wall adjacent the top of said pouch, the major portion of said liner being unattached and disposed adjacent said inner wall, said liner having a front wall, a rear wall, a front partition and a rear partition (forming) constructed to form a central open-top pocket therebetween (for holding) containing a readily removable refrigerating means, the bottom of said pocket (being) disposed adjacent the bottom of said pouch, said front partition (forming) arranged together with said front wall of said liner to form a first insulin-holding compartment (for holding a vial of insulin) and said rear partition (forming) providing together with said rear wall of said liner a second syringe-holding compartment (for holding a syringe).

2. The pouch of claim 1, wherein the upper portion of each of said opposing walls is folded inwardly and downwardly over a relatively short distance, the overlapping end portion of each fold being (attached to) positioned between said (outer wall and) inner wall (adjacent) and said means for opening and closing said pouch.

3. The pouch of claim 1, wherein said means for opening and closing comprises a strip of an adhesive tape fastener disposed in a direction generally parallel to the top edge of said pouch.

4. The pouch of claim 3, wherein said strip is secured to the folded end portion of each of said walls by an upper stitch disposed in the upper portion of said strip and by a lower stitch extending through the combined thickness of the upper end portion of said liner, said inner wall adjacent thereto, said insulating material and said outer wall.

5. The pouch of claim 1, wherein said pocket extends vertically over a distance equal to more than a half of the height of said pouch.

6. The pouch of claim 1, wherein the outer edge portion of the bottom of said central pocket is joined to the liner at the bottom portion thereof.

7. The pouch of claim 1, wherein said refrigerating means comprises a frozen ice pack which is removably insertable into said central pocket.

8. The pouch of claim 1, including a removable ice pack inserted in said central pocket, a vial of insulin placed in said first compartment and a syringe placed in said second compartment.

* * * * *